US012590454B2

(12) United States Patent
Ness

(10) Patent No.: US 12,590,454 B2
(45) Date of Patent: Mar. 31, 2026

(54) SYSTEM FOR BUILDING PREFABRICATED MODULAR, SEALED, AND PRESSURIZED HABITATS

(71) Applicant: Peter Ness, Tokyo (JP)

(72) Inventor: Peter Ness, Tokyo (JP)

( * ) Notice: Subject to any disclaimer, the term of this patent is extended or adjusted under 35 U.S.C. 154(b) by 682 days.

(21) Appl. No.: 17/512,142

(22) Filed: Oct. 27, 2021

(65) Prior Publication Data

US 2023/0130786 A1 Apr. 27, 2023

(51) Int. Cl.

| | |
|---|---|
| ***E04B 1/348*** | (2006.01) |
| ***E04B 1/38*** | (2006.01) |
| ***E04B 1/41*** | (2006.01) |
| ***E04B 1/68*** | (2006.01) |
| ***E04H 9/16*** | (2006.01) |

(52) U.S. Cl.

CPC ..... *E04B 1/388* (2023.08); *E04B 1/34815* (2013.01); *E04B 1/68* (2013.01); *E04H 9/16* (2013.01)

(58) Field of Classification Search

CPC ..... E04B 1/34815; E04B 1/388; E04B 1/68; E04H 9/16

USPC ..... 52/79.9

See application file for complete search history.

(56) References Cited

U.S. PATENT DOCUMENTS 3,201,907 A * 8/1965 Henderson ..... E04B 1/34823 52/79.5
3,704,564 A * 12/1972 Koga ..... E04B 1/6812 52/309.4
3,891,224 A * 6/1975 Ditcher ..... F16L 21/03 52/21
4,558,875 A * 12/1985 Yamaji ..... E04B 1/6801 106/DIG. 4
4,751,799 A * 6/1988 Ditcher ..... E02D 29/124 52/21
6,032,421 A * 3/2000 Yamada ..... E04G 21/161 220/4.26

(Continued)

*Primary Examiner* — James J Buckle, Jr.

(74) *Attorney, Agent, or Firm* — The Rapacke Law Group, P.A.

(57) ABSTRACT

A system for sealing prefabricated facilities or underground facilities may allow for the sealing and pressurizing of parts or all of an underground facility or enclosed facility via a plurality of sealable doors or prefabricated modules. The system may implement mechanical connections between walls or extensions of individual modules. The system may implement complementary mechanical connections or partially complementary mechanical connections between individual modules and may further include module interior or module exterior sealing layers for rigid layers. The system may implement mechanical connections between individual modules wherein each of the mechanical connections may utilize sealing complementary profiles constructed and arranged to provide for an airtight seal between modules. The system may be used to link surface facilities to underground facilities, tunnels or shafts, or to pressurize sections of tunnels or shafts. The system may be used to stabilize pressurized facilities from back-blast due to evacuation of said tunnels or shafts. The system may be used to construct pressurized surface habitats independent of, or linked to underground tunnels or facilities. The system may further be used to construct space platforms or space stations.

6 Claims, 4 Drawing Sheets

(56) References Cited

U.S. PATENT DOCUMENTS

| | | | | |
|---|---|---|---|---|
| 8,601,761 | B2 * | 12/2013 | Chadwick | E04B 2/702 52/836 |
| 11,118,348 | B2 * | 9/2021 | Strickland | E04B 2/88 |
| 2010/0257718 | A1 * | 10/2010 | Gartin | E04B 1/48 29/464 |
| 2013/0298494 | A1 * | 11/2013 | Corsi | F24S 25/615 52/705 |
| 2015/0096251 | A1 * | 4/2015 | McCandless | E04F 13/0807 52/404.3 |
| 2016/0168850 | A1 * | 6/2016 | Anseth | E04C 3/005 52/645 |
| 2016/0176105 | A1 * | 6/2016 | Stanley | E04B 1/388 156/538 |
| 2023/0130786 | A1 * | 4/2023 | Ness | E04B 1/34815 52/79.9 |

* cited by examiner

SYSTEM FOR BUILDING PREFABRICATED MODULAR, SEALED, AND PRESSURIZED HABITATS

TECHNICAL FIELD

The embodiments generally relate to airtight tunnel systems and habitats, and system of making the same.

BACKGROUND

A system for creating and maintaining pressures and temperatures similar to that of Earth's ambient pressures and temperatures for constructing habits on planetary bodies and in space, which may include utilizing prefabricated modules or modules for an enclosed facility such as a mine to seal and pressurize the enclosed facilities and provide a safe environment in which people and equipment may move, work, and live. Modules may be mechanically mated together to form sealed and pressurized habitats.

SUMMARY

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

In general, the embodiments described herein relate to the creation and constructions of prefabricated modules composed of cement and graphene, or other materials, for sealing and pressurizing of surface habitats, underground mines or tunnels, or underground facilities on planetary bodies with atmospheric pressures or temperatures differing from that of earth. The system may allow for the sealing and pressurizing of surface habitats, or parts or all of an underground facility or enclosed facility or for depressurizing or over pressurizing enclosed facilities.

A system of sealing and pressurizing an enclosed facility may include providing a module within, or attached to, a tunnel or shaft and sealing and pressurizing the tunnel or shaft on either side of the module.

A system for sealing and pressurizing an enclosed facility may include providing a prefabricated module including a frame and sealable doors, wherein the prefabricated module may be affixed to the interior, or exterior at the surface, of a tunnel system.

A system for sealing and pressurizing an enclosed facility may include multiple modules including complementary profiled connections to created sealed and pressurized habitats.

A system for sealing and pressurizing an enclosed facility may include sealingly connecting multiple modules together via complementary profiled mechanical connections including a sealing member disposed between the complementary profiles of the mechanical connection.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1A:
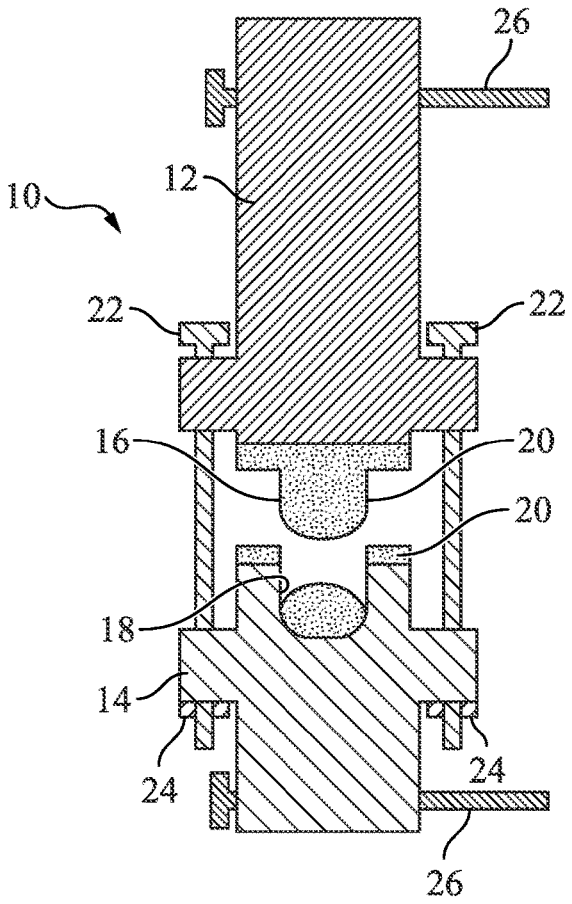
FIGS. 1A and 1B illustrates a portion of a system for building prefabricated modular, sealed, and pressurized habitats consistent with this disclosure.

The specific details of the single embodiment or variety of embodiments described herein are to the described system and methods of use. Any specific details of the embodiments are used for demonstration purposes only and no unnecessary limitations or inferences are to be understood from there.

It is noted that the embodiments reside primarily in combinations of components and procedures related to the system. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, the term "module" or variations on the term "module" may include any pressurized door, capsule-module, prefabricated door module, insert, seal, slab, or other device sufficient for providing a sealable, airtight doorway within a tunnel or shaft capable of maintaining different environments or pressures on either side of the module, a sealable pressurized habitat at the surface of the planetary body, or a sealable pressurized structure for creation of platforms, or similar, for construction of military or other facilities on the surface of planetary bodies or in space.

In general, the embodiments described herein relate to a system for sealing and pressurizing prefabricated facilities on planetary bodies, or for underground facilities in planetary bodies with atmospheric pressures or temperatures differing from that of earth. The system may allow for the sealing and pressurizing of parts or all or an underground facility or enclosed facility via a plurality of sealable doors or prefabricated modules. The system may implement mechanical connections between walls or extensions of individual modules. The system may implement complementary mechanical connections between individual modules and may further include module interior or module exterior sealing layers for rigid layers. The system may implement mechanical connections between individual modules wherein each of the mechanical connections may utilize sealing complementary profiles constructed and arranged to provide for an airtight seal between modules.

In general, the system may include prefabricated modules of a structure, such as sealed and pressurized habitats for planetary bodies, space platforms and structures, spacecraft, or space stations. Individual prefabricated modules may be connected to one another by a variety of means to form a larger structure. The system may avoid the need for welding or other various means for connecting modules together.

Prefabricated modules, which may be composed of reinforced concrete and graphene, maybe mechanically connected via mechanical connections having complementary profiles.

The system may include at least one means for assembling various modules together including lock and key or complementary profiles of mechanical attachment means such that modules may be mechanically affixed to one another additional means for securing modules together may be included such as not in bold combinations, adhesives, magnet, or the like. According to some variations a malleable material may be disposed within the complementary profile of the mechanical means for attachment to further facilitate sealing of modules together.

Figure 1B:
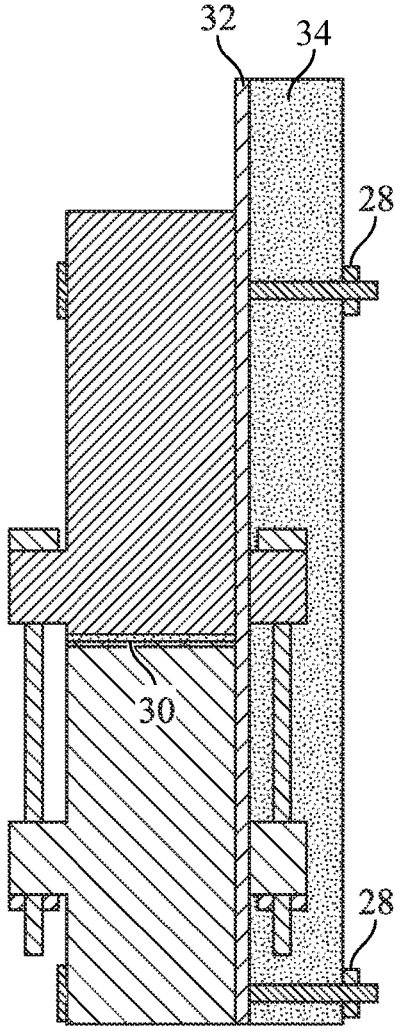

Referring to FIGS. 1A and 1B, a system for mechanical attachment 10 may include attaching a first module 12 to a second module 14. The first module 12 and second module 14 may include a first complementary profile 16 and a second complementary profile 18, respectively. The first complementary profile 16 and second complementary profile 18 may include a lock and key configuration or complementary mechanically meeting interfaces such that a seal may be created between the first module 12 and the second module 14 when the first complementary profile 16 is abutted against the second complementary profile 18. A malleable seal 20 may be disposed on at least a portion of the first complementary profile 16 and on at least a portion of the second complementary profile 18 to further facilitate sealing of the first module 12 to the second module 14. Various nut and bolt combinations may further facilitate mating of the first module 12 to the second module 14 such as, but not limited to, a first bolt 22 threaded through a portion of it the first module 12 and the second module 14 and mechanically mated to a first nut 24. As best seen in FIG. 1B, the sealing engagement 30 of the first module 12 to the second module 14 may further be facilitated by applying a sealing layer 32 to at least one side of the mated first module 12 and second module 14 in addition to and optional rigid layer 34, such as cement. Additional mechanical connection means may be implemented to draw the first module 12 and second module 14 towards the sealing layer 32 and the rigid layer 34 such as, but not limited to, a second nut and bolt combination that may include a second bolt 26 passing through the first module 12 or second module 14 and mechanically engaging with a second nut 28 to apply compressive force between the first module 12, second module 14, sealing layer 32, and rigid layer 34. It is contemplated that the sealing layer and rigid layer may be disposed on the interior of connected modules, however, various arrangements of the first module, second module, additional modules, sealing layer, and rigid layer are contemplated by this disclosure and are considered to fall within the scope of the invention.

The sealing layer 32 may include any suitable material for facilitating a seal between the engagement of the first module and the second module such as, but not limited to, rubber, paint, glue, plastic, plaster, cement, graphene, carbon fiber, or the like. The rigid layer 34 may include any suitable material for further facilitating the seal between the engagement of the first module and the second modules such as, but not limited to, cement, graphene seals, metal paneling, or various other materials that may be riveted, bolted, glued, or welded together.

Figure 2:
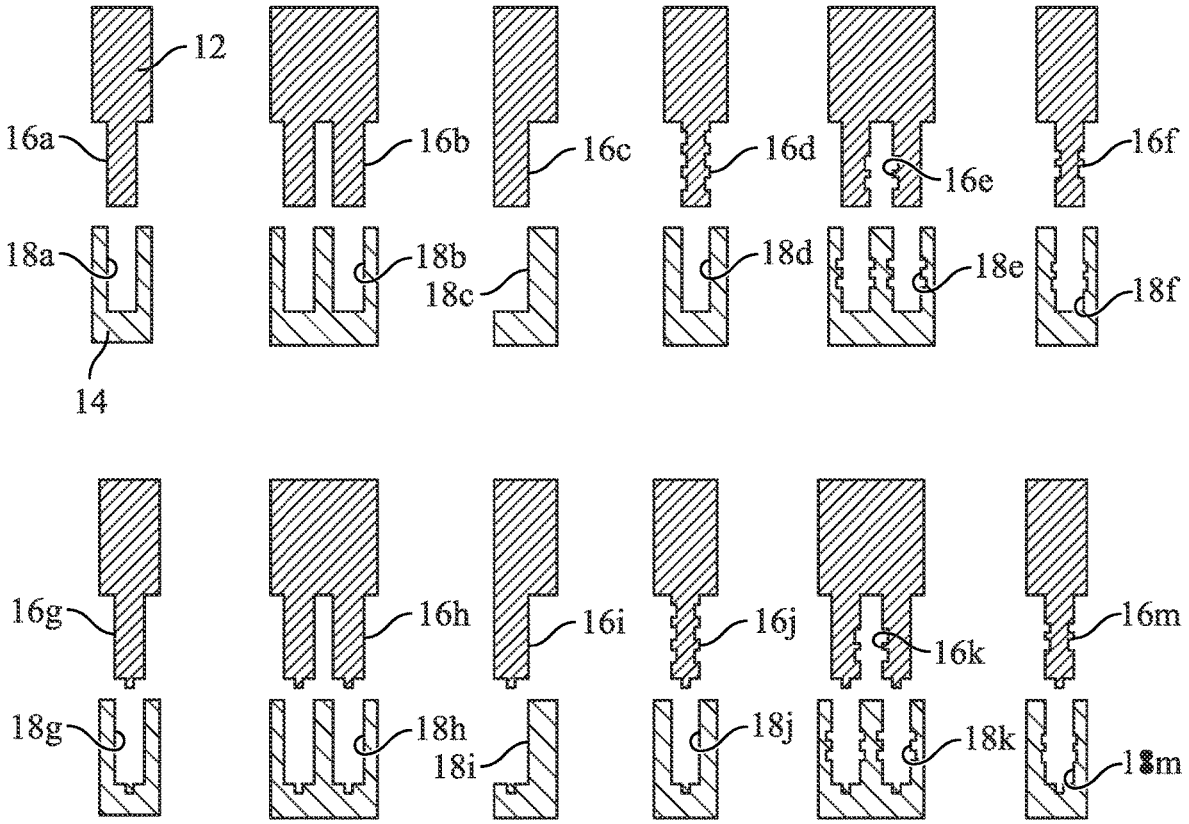
FIG. 2 illustrates a portion of a system for building prefabricated modular, sealed, and pressurized habitats consistent with this disclosure.

Referring to FIG. 2, a first module portion 12 and a second module portion 14 may include respective mechanical interfaces including complementary profiles 16*a*, 18*a*. Complementary profiles may take a variety of sizes, shapes, and variations each constructed and arranged to facilitate an airtight seal between the first module and the second module. According to some variations, the first complementary profile 16*b* may include multiple portions mating with the corresponding second complementary profile 18*b*. FIG. 2 depicts many variations on the complementary profiles 16*a* through 16*m* and 18*a* through 18*m* including several variations having partial or near-complementary profiles 16*j*, 18*j* or 16*k*, 18*k*. According to some variations, near-complementary profiles may be constructed and arranged to define malleable seal recesses to account for space in which the malleable seal 20 may be partially disposed.

Figure 3:
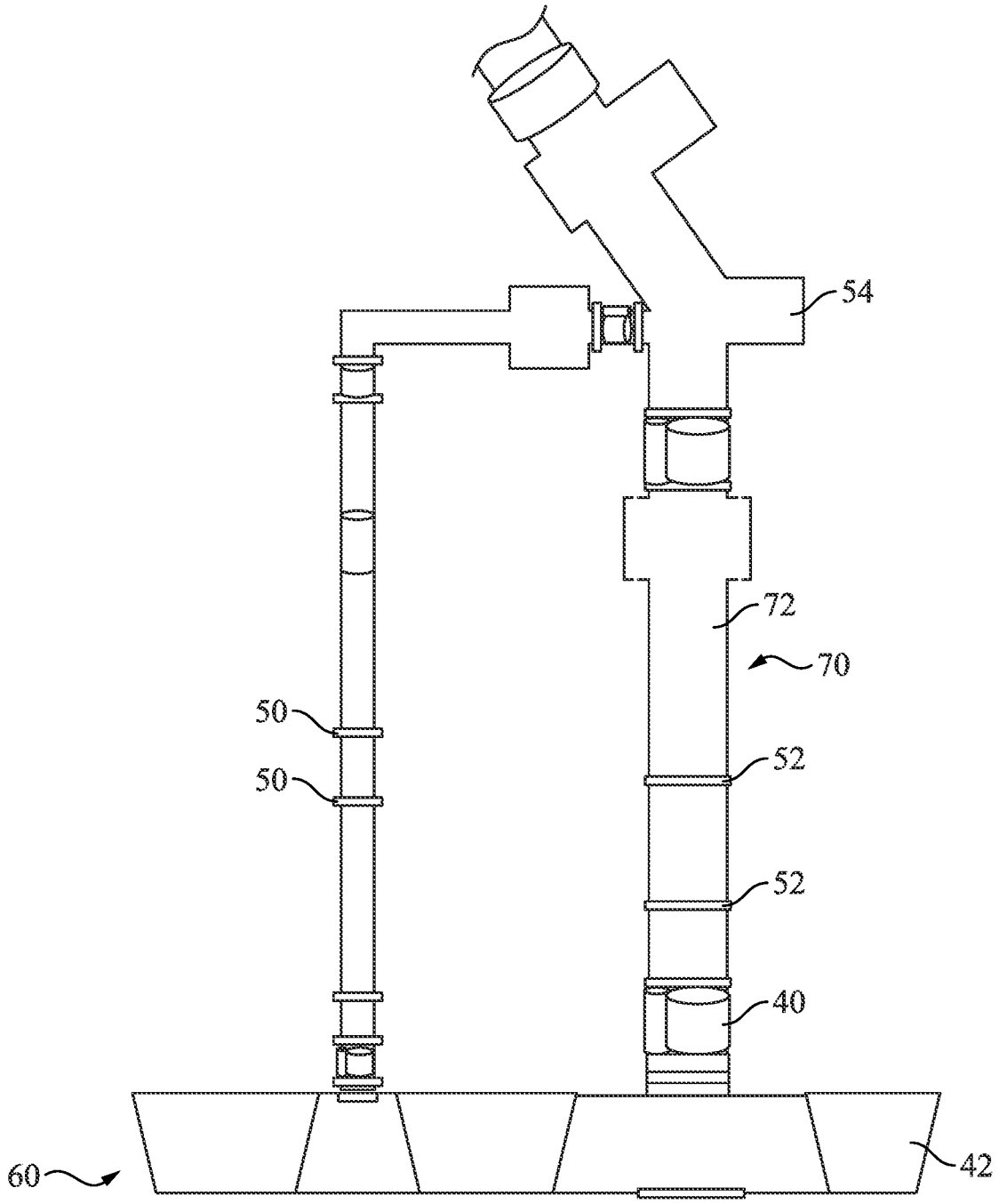
FIG. 3 illustrates a portion of a system for building prefabricated modular, sealed, and pressurized habitats consistent with this disclosure.

FIG. 3 depicts a plan view of a tunnel system including an above ground facility 42 in the natural environment 60 of a planetary body 10. The tunnel system may include a plurality of tunnels defining a tunnel surface 12 and various tunnel features such as insets 54. At least one module 40 may sealingly close off the tunnel system from the natural environment 60. A plurality of additional safety doors 50, 52 may provide a means for further sealing off the tunnel system from the natural environment 60. While FIG. 3. depicts a tunnel system including an above ground facility, the invention contemplates various applications of the means for securing modules together including manufactured buildings, spacecraft, space structures, and various other habitats or structures.

Figure 4A:
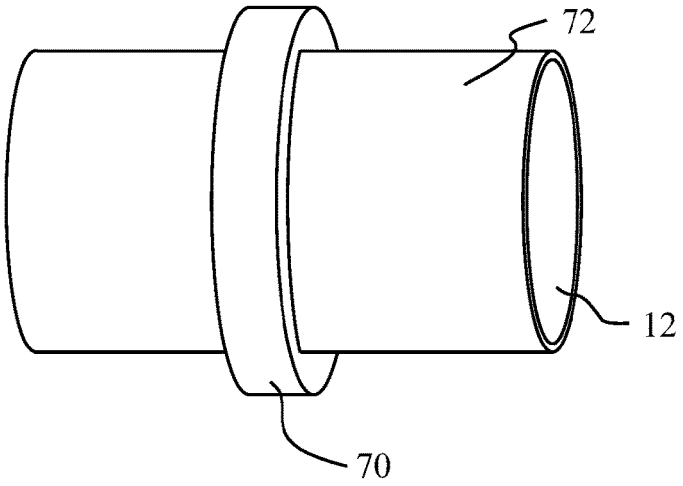
FIGS. 4A and 4B illustrate portions of a system for building prefabricated modular, sealed, and pressurized habitats consistent with this disclosure.
Figure 4B:
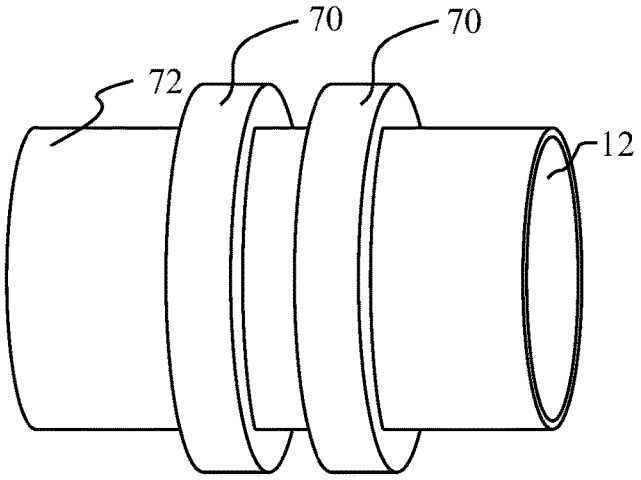

FIGS. 4A and 4B depict inserts 70 that may extend from at least a portion of a tunnel 12 outer wall 72. Inserts 70 may mechanically interface with the natural environment of a planetary body to connect, seal, or pressurize habitats, doors, walls, or other structures within a tunnel system. According to some embodiments, inserts may be prefabricated as part of a module as previously described. Inserts 70 may take a variety of sizes, shapes, materials and variations each constructed and arranged to facilitate an airtight seal between a first module and a second module and securing modules or tunnels within the natural environment of a planetary body. Inserts 70 may be rock bolted to the tunnel walls and bolted or welded together or to capsule module or habitats inserted in tunnel 12 to obtain a pressurized seal. Inserts 70 may or may not be prefabricated and connected together as components. Where inserts 70 are prefabricated, then inserted into outer wall 72, they may be affixed together by a series of bolts, levers, or welded, or via other means and a material placed between the insert 70 and tunnel wall 72 to aid with pressurization. Tunnel 12 may take a variety of sizes, shapes, and variations and the cylindrical tunnel depicted in FIGS. 4A and 4B should not be considered limiting. The tunnel 12 and inert(s) 72 may support the structure of modules and tunnels and help the system remain pressurized and withstand repeated back-blast from evacuation of underground tunnels or shafts. Additional components of inserts 70 may be affixed or rock bolted to tunnel walls 72 and connected to blast doors or any inserted modules to absorb back-blast or sudden changes in pressurization or depressurization of tunnels 12 to reduce the chance of catastrophic failure in tunnels 12.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

According to variation 1 a system for building prefabricated modular, sealed, and pressurized habitats may include a first module including a first enclosed habitat defining a first interior and first exterior and having a first mechanical connector defining a first complementary profile; a second module including a second enclosed habitat defining a second interior and second exterior and having a second connector interface defining a second complementary profile; wherein the first complementary profile and second complementary profile define a joining interface between the first mechanical connector and the second mechanical connector; a malleable seal disposed within at least a portion of the joining interface to facilitate sealing of the first module to the second module; at least one nut and bolt combination mechanically connecting the first module to the second module and further facilitating sealing of the first module to the second module; a sealing layer disposed on at least a port of the first module and second module; and a rigid layer disposed on at least a port of the first module and second module.

Variation 2 may include a system for building prefabricated modular, sealed, and pressurized habitats as in variation 1, further including at least one second nut and bolt combination that may include a second bolt disposed through at least one of the first module or second module and mechanically engaged with a second nut to apply compressive force on the first module, second module, sealing layer, and rigid layer.

Variation 3 may include a system for building prefabricated modular, sealed, and pressurized habitats as in any of variations 1 through 2 wherein the sealing layer and rigid layer are disposed on the first interior and second interior.

Variation 4 may include a system for building prefabricated modular, sealed, and pressurized habitats as in any of variations 1 through 3 wherein the sealing layer and rigid layer are disposed on the first exterior and second exterior.

Variation 5 may include a system for building prefabricated modular, sealed, and pressurized habitats as in any of variations 1 through 4 wherein the malleable seal includes at least one of rubber, cement, or adhesive.

Variation 6 may include a system for building prefabricated modular, sealed, and pressurized habitats as in any of variations 1 through 5 wherein the sealing layer includes at least one of rubber, paint, glue, plastic, plaster, cement, graphene, or carbon fiber.

Variation 7 may include a system for building prefabricated modular, sealed, and pressurized habitats as in any of variations 1 through 6 wherein the rigid layer includes at least one of cement, graphene, or metal paneling.

Variation 8 may include a system for building prefabricated modular, sealed, and pressurized habitats as in any of variations 1 through 7 wherein the first complementary profile is partially complimentary to the second complementary profile.

Variation 9 may include a system for building prefabricated modular, sealed, and pressurized habitats as in any of variations 1 through 8 wherein the second complementary profile is partially complimentary to the first complementary profile.

Variation 10 may include a system for building prefabricated modular, sealed, and pressurized habitats as in any of variations 1 through 9 wherein the first complementary profile is partially complimentary to the second complementary profile and the second complementary profile is partially complimentary to the first complementary profile.

Variation 11 may include a system for building prefabricated modular, sealed, and pressurized habitats as in any of variations 1 through 10 wherein the first complementary profile defines at least one first sealing recess constructed and arranged to receive at least a portion of the malleable seal disposed within at least a portion of the joining interface.

Variation 12 may include a system for building prefabricated modular, sealed, and pressurized habitats as in any of variations 1 through 11 wherein the second complementary profile defines at least one second sealing recess constructed and arranged to receive at least a portion of the malleable seal disposed within at least a portion of the joining interface.

According to variation 13, system for building prefabricated modular, sealed, and pressurized habitats may include a first module including a first enclosed habitat defining a first interior and first exterior and having a first mechanical connector defining a first partially complementary profile; a second module including a second enclosed habitat defining a second interior and second exterior and having a second connector interface defining a second partially complementary profile; wherein the first partially complementary profile and second partially complementary profile define a joining interface and at least one sealing recess between the first mechanical connector and the second mechanical connector; a malleable seal disposed within the at least one sealing recess and joining interface to facilitate sealing of the first module to the second module; at least one nut and bolt combination mechanically connecting the first module to the second module and further facilitating sealing of the first module to the second module; a sealing layer disposed on at least a port of the first module and second module; and a rigid layer disposed on at least a port of the first module and second module.

Variation 14 may include a system for building prefabricated modular, sealed, and pressurized habitats as in variation 13 wherein the sealing layer and rigid layer are disposed on the first interior and second interior.

Variation 15 may include a system for building prefabricated modular, sealed, and pressurized habitats as in any of variations 13 through 14 wherein the sealing layer and rigid layer are disposed on the first exterior and second exterior.

Variation 16 may include a system for building prefabricated modular, sealed, and pressurized habitats as in any of variations 13 through 15 wherein the malleable seal includes at least one of rubber, cement, or adhesive.

Variation 17 may include a system for building prefabricated modular, sealed, and pressurized habitats as in any of variations 13 through 16 wherein the sealing layer includes at least one of rubber, paint, glue, plastic, plaster, cement, graphene, or carbon fiber.

Variation 18 may include a system for building prefabricated modular, sealed, and pressurized habitats as in any of variations 13 through 17 wherein the rigid layer includes at least one of cement, graphene, or metal paneling.

According to variation 19, a system for building prefabricated modular, sealed, and pressurized habitats may include a first module including a first enclosed habitat defining a first interior and first exterior and having a first mechanical connector defining a first partially complementary profile; a second module including a second enclosed habitat defining a second interior and second exterior and having a second connector interface defining a second partially complementary profile; wherein the first partially complementary profile and second partially complementary profile define a joining interface and at least one sealing recess between the first mechanical connector and the second mechanical connector; a malleable seal including at least one of rubber, cement, or adhesive disposed within the at least one sealing recess and joining interface to facilitate sealing of the first module to the second module; at least one nut and bolt combination mechanically connecting the first module to the second module and further facilitating sealing of the first module to the second module; a sealing layer including at least one of rubber, paint, glue, plastic, plaster, cement, graphene, or carbon fiber disposed on at least a port of the first module and second module; and a rigid layer including at least one of cement, graphene, or metal paneling disposed on at least a port of the first module and second module.

Variation 20 may include a system for building prefabricated modular, sealed, and pressurized habitats as in variation 19 further including at least one second nut and bolt combination that may include a second bolt disposed through at least one of the first module or second module and mechanically engaged with a second nut to apply compressive force on the first module, second module, sealing layer, and rigid layer.

Variation 21 may include a system for building prefabricated modular, sealed, and pressurized habitats as in variations 19 and 20, wherein the system is constructed and arranged for connecting at least one of prefabricated modular, sealed, and pressurized habitats, doors, or seals to tunnel or shaft walls to support the system and maintain pressure within the system and withstand back-blast from evacuation of said system.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for anyone of the elements in the claims below or that a single element can be substituted for two or more elements in a claim. Although elements can be described above as acting in certain combinations, and even initially claimed as such, it is to be expressly understood that one or more elements from a claimed combination can, in some cases, be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible considering the above teachings without departing from the following claims.

What is claimed is:

1. A system for building prefabricated modular, sealed, and pressurized habitats, comprising:

a first module comprising a first enclosed habitat defining a first interior and first exterior and having a first mechanical connector defining a first partially complementary profile comprising a key feature and at least one first sealing recess;

a second module comprising a second enclosed habitat defining a second interior and second exterior and having a second connector interface defining a second partially complementary profile comprising a complementary groove and at least one second sealing recess;

wherein the first partially complementary profile and second partially complementary profile define a joining interface and the first and second sealing recesses are constructed and arranged to receive a malleable seal at least in part within the joining interface;

a malleable seal positioned at least partially within the first and second sealing recesses and the joining interface, the malleable seal comprising at least one of rubber, cement, or graphene to facilitate sealing of the first module to the second module;

a sealing layer disposed on at least a portion of a first exterior and a portion of a second exterior of the first module and second module;

a rigid layer disposed on at least a portion of a first exterior and a portion of a second exterior of the first module and second module; and a first nut and bolt combination and a second nut and bolt combination, each disposed through at least one of the first module or the second module, the second nut and bolt combination being engaged with a second nut to apply compressive force across the first module, the second module, the sealing layer, and the rigid layer, thereby further facilitating sealing of the first module to the second module;

wherein the joined modules are constructed and arranged to maintain internal pressurization and to withstand back-blast from evacuation of the joined system.

2. A system for building prefabricated modular, sealed, and pressurized habitats as in claim 1 wherein the sealing layer and rigid layer are disposed on the first interior and second interior.

3. A system for building prefabricated modular, sealed, and pressurized habitats as in claim 1 wherein the sealing layer and rigid layer are disposed on the first exterior and second exterior.

4. A system for building prefabricated modular, sealed, and pressurized habitats as in claim 1 wherein the malleable seal comprises at least one of rubber, cement, or adhesive.

5. A system for building prefabricated modular, sealed, and pressurized habitats as in claim 1 wherein the sealing layer comprises at least one of rubber, paint, glue, plastic, plaster, cement, graphene, or carbon fiber.

6. A system for building prefabricated modular, sealed, and pressurized habitats as in claim 1 wherein the rigid layer comprises at least one of cement, graphene, or metal paneling.

* * * * *